US008261591B2

(12) United States Patent
Hielscher

(10) Patent No.: US 8,261,591 B2
(45) Date of Patent: Sep. 11, 2012

(54) APPARATUS FOR HOT-FORMING, PRESS-QUENCHING, AND CUTTING SEMIFINISHED HARDENABLE-STEEL WORKPIECE

(75) Inventor: Christian Hielscher, Delbrueck (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 349 days.

(21) Appl. No.: 12/508,620

(22) Filed: Jul. 24, 2009

(65) Prior Publication Data

US 2010/0018277 A1 Jan. 28, 2010

(30) Foreign Application Priority Data

Jul. 25, 2008 (DE) ..... 10 2008 034 996

(51) Int. Cl.
*B21D 22/21* (2006.01)

(52) U.S. Cl. ..... 72/350; 72/334; 72/342.3; 72/348; 72/351

(58) Field of Classification Search ..... 72/294, 72/335, 342.3, 348, 349, 350, 351, 261, 364, 72/462, 463, 467, 332, 333, 334; 148/643, 148/647, 649, 654

See application file for complete search history.

(56) References Cited

U.S. PATENT DOCUMENTS

| | | | | |
|---|---|---|---|---|
| 2,331,491 | A * | 10/1943 | Menkin | 72/329 |
| 2,422,952 | A * | 6/1947 | Dakin | 29/565 |
| 3,584,487 | A * | 6/1971 | Carlson | 72/38 |
| 4,356,717 | A * | 11/1982 | Okunishi et al. | 72/342.3 |
| 5,119,658 | A * | 6/1992 | de Smet | 72/57 |
| 5,628,224 | A * | 5/1997 | McClung et al. | 72/336 |
| 6,397,651 | B2 * | 6/2002 | Usui et al. | 72/294 |
| 6,878,220 | B2 * | 4/2005 | Gehringhoff et al. | 148/654 |
| 6,910,358 | B2 * | 6/2005 | Schroth | 72/57 |

* cited by examiner

*Primary Examiner* — Dana Ross
*Assistant Examiner* — Homer Boyer
(74) *Attorney, Agent, or Firm* — Andrew Wilford

(57) ABSTRACT

A semifinished hardenable-steel workpiece is introduced into a gap between a punch tool and a complementary die tool while the workpiece is heated above the $AC_3$ point. Then one of the tools is vertically shifted toward the other tool so as to deform the workpiece to a predetermined shape. Subsequently the workpiece is gripped between the punch and the die tools while cooling at least one of the tools to press-quench the workpiece. Finally, but before the press-quenching is completed, an edge is cut off the still hot workpiece by relatively shifting an upper die and a lower die vertically past each other.

8 Claims, 3 Drawing Sheets

APPARATUS FOR HOT-FORMING, PRESS-QUENCHING, AND CUTTING SEMIFINISHED HARDENABLE-STEEL WORKPIECE

FIELD OF THE INVENTION

The present invention relates to a steel-workpiece processing apparatus. More particularly this invention concerns an apparatus for hot-forming, press-quenching, and cutting a semifinished workpiece of hardenable steel.

BACKGROUND OF THE INVENTION

A standard apparatus for hot-forming and press-quenching a semifinished workpiece made of hardenable steel has a die with a cavity and a punch with a complementary shaping part which are movable relative to one another, and a hold-down element. The apparatus further has a cutting device having an upper and a lower blade. Such an apparatus is used for shaping, cutting, and press-hardening a hardenable-steel workpiece that is loaded into the apparatus when heated above the $AC_3$ point.

Growing demands on modern structures, particularly in automotive manufacturing, with respect to impact behavior and minimal fuel consumption are increasingly requiring the use of high-strength and ultrahigh-strength steels. Hot-forming and press-quenching, known from GB 1,490,535, are frequently used in this regard. This patent discloses a method for press-forming and hardening sheet steel having low thickness and good dimensional stability, in which a sheet made of boron alloy steel is heated to a temperature above the $AC_3$ point, and within less than 5 seconds is pressed into the final shape between two indirectly cooled tools, resulting in a significant change in shape, and while still inside the press is subjected to rapid cooling in such a way that a martensitic and/or bainitic structure is obtained. Use of these measures results in a workpiece with high dimensional accuracy, good dimensional stability, and high strength values which is well suited for structural and safety-related parts in automotive manufacturing. Preshaped components as well as flat sheets may be hot-formed and press-quenched. For preshaped components, the shaping process may also be limited to shaping of a small percentage of the final geometry, or to sizing.

After the hot-forming and press-quenching, such high-strength and ultrahigh-strength steels have tensile strengths greater than 1000 MPa. The hardened components can then be cut only by using special processes. One common process in industrial mass production is laser cutting, which, however, is carried out on the hardened component as an additional production step following the hot-forming and press-quenching, and involves long cycling times and high capital costs. For this reason the process has a precise tolerance.

Another production process performed after hot-forming and press-quenching is so-called hard cutting, as disclosed in US 2007/0062360, for example. Hard cutting is performed on the hardened component, using special presses. This reference discloses a press and a method for hard cutting of a workpiece, in which the press has spacers located as close as possible to the cutting zone. At the moment of fracture of the workpiece, the spacers form a fixed stop which brings the motion of the press in the cutting direction to a standstill. This allows a zero gap to be provided between the upper blade and the lower blade. As a result, wear, noise generation, and cutting shock are minimized and a particularly fine cutting profile is achieved with minimal burr formation. However, the hard cutting process lengthens the production chain and requires additional complicated tools which are maintenance-intensive.

Therefore, it would be advantageous if a component required no trimming at all after hot-forming and press-quenching. US 2006/0137779 discloses a method for producing a metallic shaped component, in which a component blank is produced from a semifinished workpiece made of unhardened heat-treatable sheet steel, using a cold forming process such as deep drawing. The component blank is then cut on the edges to form a border shape approximating that of the component to be produced. The component blank trimmed in this manner is then heated and press quenched in a hot-forming tool. However, the heating, hot-forming, and press-quenching always cause a change in the component compared to the unheated state. Subsequent trimming can therefore be omitted only if the tolerance specification for the component is so broad that this change is still within the allowable tolerance. However, the allowable tolerance specifications are often narrower.

The same applies for so-called direct hot-forming, in which in a single shaping step a finished component is shaped and press quenched from a heated sheet. The sheet metal blank is first optimized in a prototype tool until no trimming is necessary after the shaping and press-quenching. However, direct hot-forming requires simple geometries and broad tolerance specifications. Trimming is unavoidable for more complex components with narrow tolerances.

Therefore, it would be practical to perform necessary trimming at a time when the component is no longer undergoing a change in shape and the hardening has not yet been completed. This point in time is located during the actual hot-forming, as soon as the contour is shaped and before the holding period. A generic hot-forming apparatus having cutting tools and a corresponding method are known from DE 10 2006 026 805. This reference discloses an apparatus for hot-forming and press-quenching of a semifinished workpiece made of hardenable steel, having a die with a front face and a punch with a protruding shaping part which are movable relative to one another, and a hold-down element, and the apparatus, which may be activated during and/or after the shaping process, including a cutting device having an upper and a lower blade. The trimming is advantageously carried out in the shaping apparatus, i.e. when the component is still warm. Thus, at this point the component does not have high strength, since it has not yet completely cooled and therefore is not fully hardened. In addition, separate tools or devices are not required; all that is needed is a single apparatus for hot-forming which also includes at least one cutting device. Furthermore, the hold-down element may be supported so that it is movable relative to the punch and/or the die. The hold-down element may also be connected to the punch, in particular in a spring-loaded manner. For discharging scrap pieces, the hold-down element advantageously has at least one oblique outer surface, whereby the scrap pieces separated from the component are discharged from the side of the apparatus. The step of trimming the component advantageously begins before its final shaping, particularly preferably with a trimming allowance with respect to the final shaping of the component. The final shaping is not performed until a final stroke of 1 mm, which causes the material of the semifinished workpiece to be indented slightly, i.e., drawn inward, in the region of the cut edge. In addition to trimming of the circumferential edge of the semifinished workpiece or the almost completely formed component, perforations or punches may be provided within the face of the semifinished workpiece or component during the cutting process. Alternatively, the punch may be moved in the direction of the die. A problem with the apparatus disclosed in DE 10 2006 026 805 is the fact that the trimming is performed just before the end of the shaping process. Tolerances can then be ensured only for simple cut edges. For complex components such as a B-column for a motor vehicle, the tolerances to be observed become problematic because the indentation of the material after cutting is not linear.

OBJECTS OF THE INVENTION

It is therefore an object of the present invention to provide an improved apparatus for hot-forming, press-quenching, and cutting a semifinished hardenable-steel workpiece.

Another object is the provision of an improved apparatus method of hot-forming, press-quenching, and cutting a semifinished hardenable-steel workpiece.

SUMMARY OF THE INVENTION

An apparatus for hot-forming and press-quenching a semifinished workpiece of hardenable steel has according to the invention a die, a complementary punch with a shaping part. An upper blade and a lower blade are attached to the punch and die. A stationary press plate is fixed to the die. A movable press ram is limitedly shiftable relative to the punch. Actuator means engages the ram for moving the die and punch toward and away from each other.

A hold-down element is preferably provided for shaping complex geometries. In addition, a movably supported spacer is advantageously fixed to a lower tool on which first the hold-down element and then the upper tool may rest. This arrangement guarantees that cutting is not performed until the shaping process has ended. The hold-down element is optionally associated with the punch. A clearance is provided beneath the upper blade. This measure simplifies scrap disposal due to the fact that a cut-off piece is able to freely fall at the side of the die solely due to gravity. To make holes in the semifinished product, secondary punches able to move independently of the pressing direction are preferably mounted in the punch and/or the die and/or the hold-down element. This prevents the secondary punch from jamming in the component that shrinks during hardening. The press does not open until the holding period has elapsed and the workpiece is fully quenched, that is well below the $AC_3$ point.

The method according to the invention for hot-forming, press-quenching, and cutting the semifinished workpiece made of hardenable steel to produce a component has a first step of taking a semifinished workpiece is heated above the $AC_3$ point and putting it into the an apparatus according to the invention. The cutting of the semifinished workpiece is carried out only after the hot-forming of the semifinished workpiece by the punch has been completed, but before the press-quenching has concluded. In particular for a complex geometry, the hold-down element is first placed on the spacer to ensure a gap for insertion of the semifinished workpiece into the tool during the hot-forming. When the shaping process by use of the punch has ended, the entire upper tool is placed on the spacer. The spacer then travels a specified distance in order to place the hold-down element on a flange of the semifinished product, close the gap, and shape the flange of the semifinished workpiece into the final geometry. Finally, the press ram travels a remaining distance over the punch which is supported so that it is movable relative to the press ram, the hold-down element, and the spacer in order to bring the blades into the working position and trim the component. After hot-forming of the semifinished workpiece by use of the punch, a secondary punch which is able to move independently of the pressing direction and which is mounted in the punch and/or the die and/or the hold-down element is preferably brought into the working position, and the secondary punch punches the semifinished workpiece and is immediately retracted. A resulting punch slug may be disposed of via a passage.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
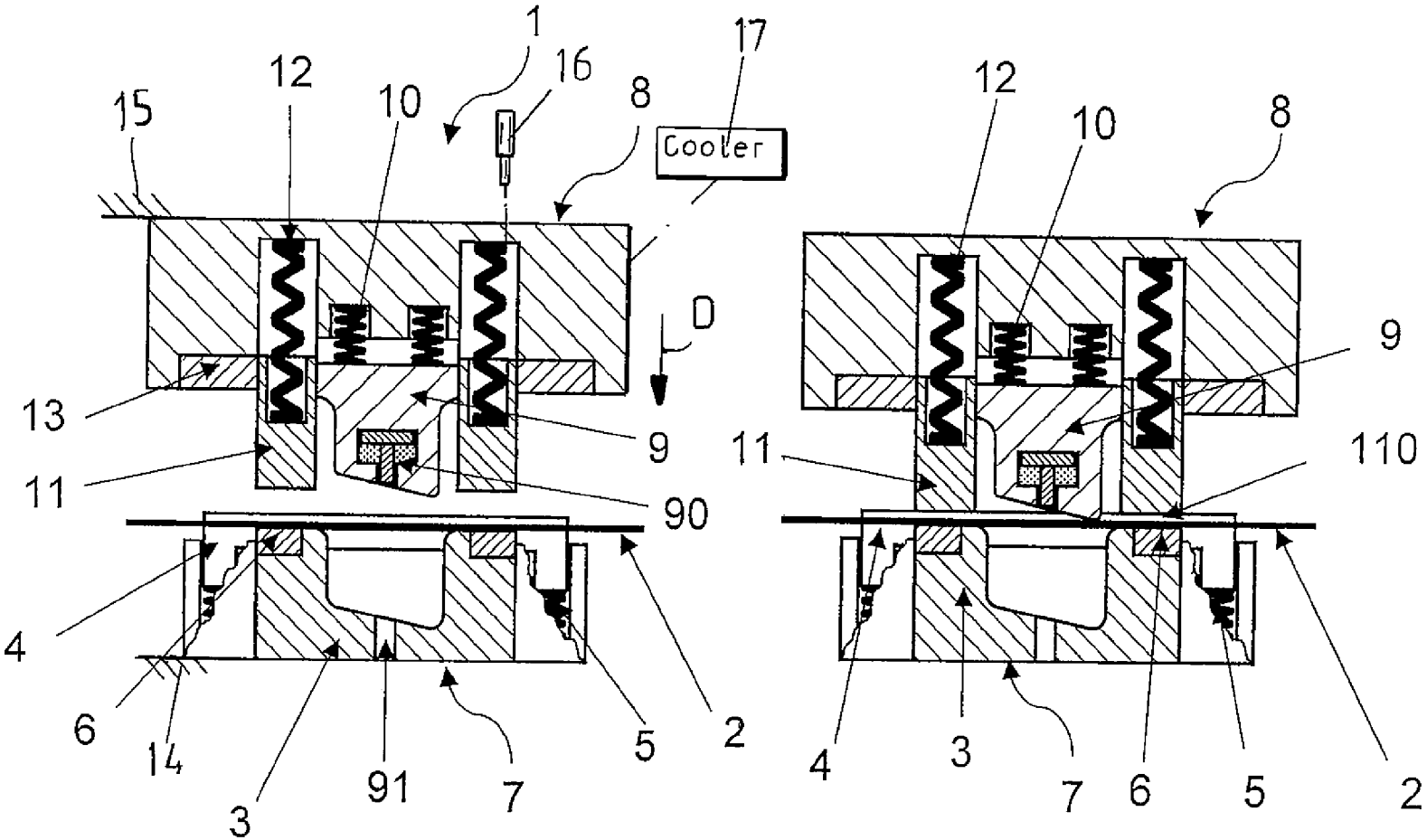
FIG. 1 is a first step of the method according to the invention.
FIGS. 2-6 are the second through sixth steps of the method.

As seen in FIG. 1 a hot-forming apparatus 1 is still open. A semifinished workpiece 2, in this case a flat sheet heated above the $AC_3$ point, has just been placed on a lower shaping die 3. On each side of the die 3 is a spacer 4 that is vertically movably supported on springs 5. In the shaping region lower blades 6 are mounted on the both sides of the die 3. The lower blades 6, die 3, spacer 4, and springs 5 form a lower tool 7 that is fixed to a lower press platen illustrated schematically at 14.

An upper tool 8 is formed by a punch 9 vertically movably supported on springs 10, and hold-down elements 11 vertically movably supported on springs 12 on all sides of the punch 9. Upper blades 13 are located on both sides of the hold-down elements 11. The upper tool 8 is fixed to a press ram shown schematically at 15. A cooler 17 is attached to the upper tool 8, and also if desired to the lower tool 7 to ensure good quenching of the workpiece 2 as will be described below.

A secondary punch 90 movable by an actuator 16 vertically in the punch 9 in a vertical pressing direction D is generally centered in the punch 9. A passage 91 is provided opposite the secondary punch 90 in the primary die 3 through which a punch slug resulting from the punching process of the secondary punch 90 may be ejected. In another possible variant not illustrated, a secondary punch is in the upper tool 8, and extends in a passage through the movably supported primary punch 9, or in another variant, the secondary punch 90 is guided in or through the hold-down elements 11.

In FIG. 1 the upper tool 8 has not yet contacted the semifinished workpiece 2. The manner in which the movably supported parts of the apparatus 1 according to the invention can be moved is not critical. The punch 9 may be movably supported by means of mechanical springs, hydraulic cylinders, or nitrogen gas springs, for example. The same is true for the spacer 4 and hold-down elements 11. According to the invention, the separate secondary punch 90 may be moved both forward and backward independently of movement of the other parts.

In contrast to the generic prior art, in the apparatus 1 according to the invention the semifinished workpiece 2 is placed on the die 3 and not on the hold-down elements. According to the invention, the punch 9 and hold-down elements 11 are mounted on the upper tool 8 with planar upper faces of the die 3 and hold-down elements 11 flush, that is coplanar. Stable designs of the blades 6 and 13 and the hold-down elements 11 may be achieved in this manner.

Significant forces act during cutting, even under warm conditions. The upper blade 13 is tightly screwed to the upper tool 8, and the lower blade 6 is fixed to the die 3. The upper blade 13 is able to easily slide past the lower blade 6, thereby simplifying scrap disposal. More detailed information is provided in the discussion with reference to FIG. 6. For worn or destroyed blades 6 and 13, the design according to the invention increases the risk that scrap may inadvertently fall into the die 3 mounted on the lower tool 7, or that contaminants may collect in the die 3. However, the advantages of simpler scrap disposal outweigh this possible disadvantage of the apparatus 1 according to the invention.

In FIG. 2 the hold-down elements 11 have pressed the workpiece 2 down onto the spacers 4, which here are in bars. The punch 9 contacts the sheet 2. The springs 5 for the bar 4 and the springs 10 on the punch 9 are under pretension, so that at this point in the process neither the punch 9 nor the bar 4 can be separately moved. Only the hold-down elements 11 are movable on their springs 12, so that these springs 12 may be compressed by the continuously closing motion of the press. The hold-down elements 11 are spaced apart in such a way that the sheet 2 is able to enter the tool 7, 8 in a controlled manner through a slightly open gap 110 between the hold-down elements 11 and the die 3. The lower blades 6 are also a part of the shaping die 3.

Figure 3:
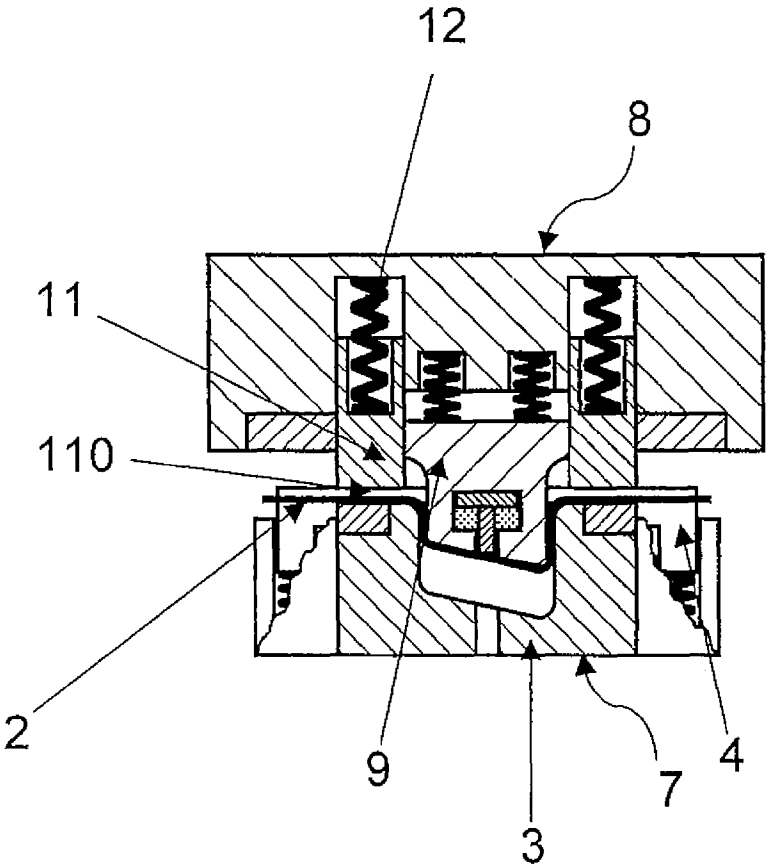

In FIG. 3 the shaping process has started. The upper tool 8 has been moved by the actuator 16 in the direction D down into the lower tool 7 by the press ram 15. The punch 9 has partially forced the semifinished workpiece 2 into the die 3. As a result of the fixed gap 110, the edge of the semifinished workpiece 2 follows into the die 3. However, the shaping process is not yet complete. The spacer 4 as well as the punch 9 are still fixed with respect to the press ram. Only the springs 12 for the hold-down elements 11 have been further compressed.

Figure 4:
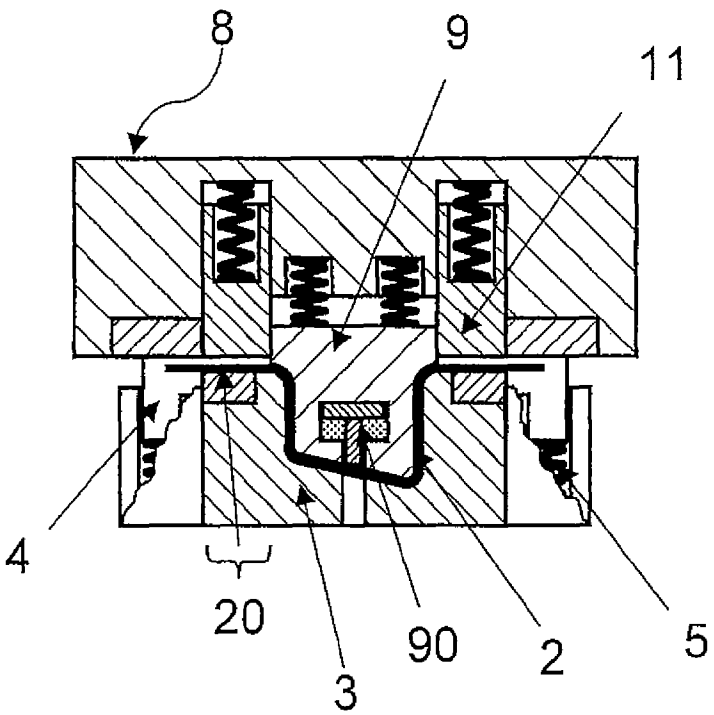

In FIG. 4 the shaping process effected by the punch 9 has ended. A hat-shaped or cup-like profile has been imparted to the sheet 2. At this point the entire upper tool 8 rests on the spacer 4. Due to the gap 110 between the hold-down elements 11 and the die 3, only a flange 20 between the hold-down elements 11 and the die 3 has not undergone final shaping. The flange 20 is a part of the final shape of the semifinished workpiece 2, and is outside the trim area. To remove any creases from this flange 20 and for final shaping and hardening of the flange 20, the springs 5 for the spacer 4 must deflect at this time. When the shaping process by use of the punch 9 has ended, the punch 90 may be brought into the working position, and the shaped but not yet fully hardened semifinished workpiece 2 may be punched.

Figure 5:
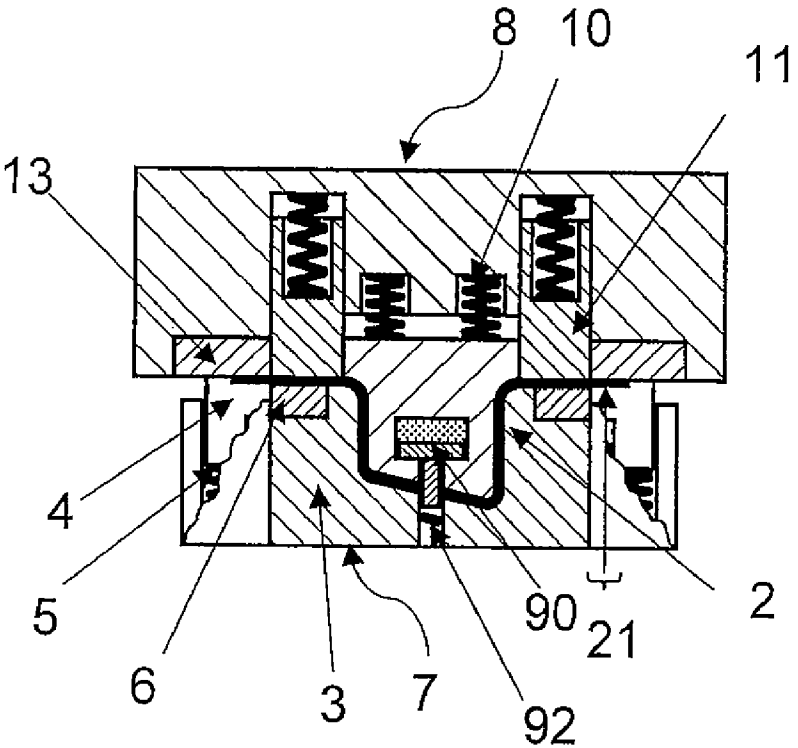

In FIG. 5 the springs 5 for the spacer 4 have been compressed, but are not yet stopped, that is bottomed out and no longer compressible. The gap 110 between the hold-down elements 11 and the die 3 no longer exists. The upper tool 8 is spaced in the direction D from the lower tool 7 by the thickness of the workpiece 2. As a result, the hold-down elements 11 rest directly on the finally shaped component 2, and the flange 20 is smoothed. All shaping processes are completed, and it is no longer possible to draw the finally shaped component 2 into the closed tools 7 and 8. However, the component 2 must still harden further before it may be removed from the press at the end of the holding period. Thus, the section 21 of the component 2 to be cut off is not yet completely hardened, so that trimming at this time is advantageous. However, the upper blades 13 and the lower blades 6 are not yet in the working position. To allow the press to move a farther distance despite the tools 7 and 8 that are already closed, at this time the springs 10 for the punch 9 must compress and the springs 5 for the spacer 4 must be further compressed. The punch 90 is independently moved in the direction of the passage 91, and has punched a slug 92 out of the center of the semifinished product. The slug 92 is ejected through the passage 91. The punching could also be done slightly later, although it should be carried out before hardening has been completed.

Figure 6:
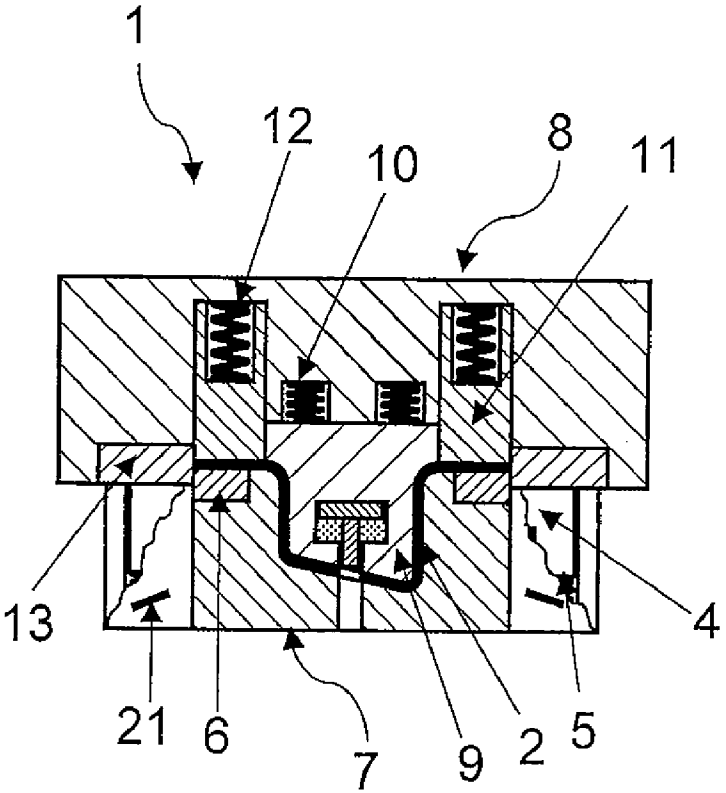

In FIG. 6 the press ram has traveled the last distance in the direction of the press platen. The upper blades 13 have passed the lower blades 6, thereby separating the still warm cut-off pieces 21 from the finally shaped component 2. The springs 12 for the hold-down elements 11, as well as the springs 10 for the punch 9 and the springs 5 for the spacer 4 are at the ends of their travel or compression, or rest on stops. The upper tool 8 bears completely on the lower tool 7. The separated cut-off pieces 21 are discharged as scrap.

As a result of the design according to the invention, the cut-off pieces 21 may be easily disposed of by providing a scrap container (not illustrated in greater detail) beneath the upper blade 13, into which the cut-off piece 21 automatically drops due to gravity. The secondary punch 90 has already been withdrawn from the component 2 to prevent the secondary punch 90 from becoming jammed in the component 2 as the result of shrinkage during the hardening process.

Following FIG. 6, the apparatus 1 may be reopened and the finished component 2 removed.

The design of a hot-forming and hardening tool 1 according to the invention with multiple moving parts is inherently complex, since hot-forming tools are indirectly cooled for hardening and therefore are provided with numerous cooling passage in which coolant is circulated. The more movable parts that a hot-forming tool has, the more complex the conduction through the cooling passages. In contrast to an edge that is trimmed using a mechanical press after hardening, the edge trimmed using the apparatus according to the invention has a smooth, clean surface, thereby minimizing the risk of hydrogen embrittlement

I claim:

1. An apparatus for hot-forming and press-quenching a semifinished sheet workpiece of hardenable steel, the apparatus comprising:

a stationary die tool having a die cavity;

a press ram movable toward and away from the die tool;

a complementary punch tool with a shaping part fittable into the die cavity and a face adapted to support the workpiece heated to above the $AC_3$ point so as to be deformable, the punch tool being carried on and limitedly shiftable relative to the press ram;

a first blade fixed on the press ram;

a second blade fixed on the stationary die tool;

a holddown element carried on and limitedly shiftable relative to the press ram;

actuator means for shifting the press ram toward the die and thereby:

first engaging the punch tool with the workpiece and pressing the punch tool with the workpiece into the die cavity without gripping the workpiece between the holddown and the die tool, whereby the workpiece is deformed, once the punch tool is fully engaged in the die cavity, pressing the holddown element directly against the workpiece and clamping the workpiece to the die with a portion of the workpiece projecting over the second blade from between the die tool and holddown element, and thereafter shifting the first blade past the second blade to trim off the projecting portion of the workpiece; and means for cooling at least one of the tools and thereby press-quenching the workpiece after the workpiece has been deformed by the punch tool, whereby the projecting edge is cut off before it is quenched.

2. The apparatus defined in claim 1 wherein the punch tool is vertically shiftable against a downwardly effective spring force in the press ram.

3. The apparatus defined in claim 1, further comprising a support element adjacent the die tool and vertically shiftable downward from an upper position against an upwardly effective spring force.

4. The apparatus defined in claim 3 wherein in an upper position an upper face of the support element is substantially coplanar with an upper face of the die tool.

5. A method of shaping, quenching, and cutting a semifinished sheet workpiece of hardenable steel, the method comprising the steps of sequentially:

introducing the workpiece into a gap between a punch tool and a complementary die tool while the workpiece is heated above the $AC_3$ point;

vertically shifting one of the tools toward the other tool so as to deform the workpiece to a predetermined shape while the workpiece only engages the die tool and the punch tool while cooling at least one of the tools to press-quench the workpiece;

pressing the workpiece against the die tool and a blade fixed thereto with a holddown element such that a portion of the workpiece projects from between the holddown element and the blade fixed to the die tool; and cutting off the projecting portion of the workpiece by shifting another blade past the blade fixed to the die.

6. The method defined in claim 5 wherein during the pressing step the tools are not moved significantly relative to each other.

7. The method defined in claim 5, further comprising the step of:

pressing a secondary punch tool through the workpiece 2 to cut a slug therefrom after vertically shifting one of the tools toward the other tool.

8. The method defined in claim 5, further comprising the step of engaging a vertically shiftable support up against the holddown element at least prior to the press-quenching step.

* * * * *